US005875775A

United States Patent [19]

Nur et al.

[11] Patent Number: 5,875,775

[45] Date of Patent: Mar. 2, 1999

[54] PROTECTIVE BREATHING MASK

[75] Inventors: Benyamin Nur, Ramat Hakovesh, Israel; Todd A. Resnick, Stuart, Fla.

[73] Assignee: Duram Rubber Products, Ramat Hakovesh, Israel

[21] Appl. No.: 835,566

[22] Filed: Apr. 9, 1997

[51] Int. Cl.[6] ..... A62B 29/00; A62B 37/00

[52] U.S. Cl. ..... 128/201.28; 128/201.25; 128/206.12; 128/206.17

[58] Field of Search ..... 128/201.22, 201.23, 128/201.24, 201.25, 201.26, 201.28, 201.17, 205.27, 206.12, 206.17, 206.19, 205.15, 205.16, 205.22, 205.24, 205.29

[56] References Cited

U.S. PATENT DOCUMENTS

| | | | |
|---|---|---|---|
| 4,411,023 | 10/1983 | Pinson | 128/201.26 |
| 4,768,235 | 9/1988 | Webster | 2/205 |
| 4,807,614 | 2/1989 | Van Der Smissen et al. | 128/201.23 |
| 4,870,959 | 10/1989 | Reisman et al. | 128/201.25 |
| 4,896,665 | 1/1990 | Gervais | 128/201.25 |
| 4,935,966 | 6/1990 | Hosuchi et al. | 2/202 |
| 5,016,625 | 5/1991 | Hsu et al. | 128/201.25 |
| 5,113,527 | 5/1992 | Robertson-McKenzie | 2/7 |
| 5,146,636 | 9/1992 | De La Pena | 2/202 |
| 5,392,465 | 2/1995 | Shou | 128/201.22 X |
| 5,452,712 | 9/1995 | Richardson | 158/201.25 |
| 5,526,804 | 6/1996 | Ottestad | 128/201.25 |
| 5,617,849 | 4/1997 | Springett et al. | 128/206.24 |
| 5,653,225 | 8/1997 | Schegerin | 128/201.24 |

FOREIGN PATENT DOCUMENTS

| | | | |
|---|---|---|---|
| 2233905 | 1/1991 | United Kingdom | 128/201.25 |

*Primary Examiner*—Mickey Yu
*Assistant Examiner*—Dinh X. Nguyen
*Attorney, Agent, or Firm*—Edward Langer, Pat. Atty.

[57] ABSTRACT

An improved protective breathing mask comprising fire-resistant stretchable material shaped as a hood for wearing over and enclosing the head. An access opening allows the head to be placed therethrough such that a substantially airtight closure is provided at the neck. The mask includes a visor and filter materials sealed to the stretchable material. The improvement to the basic mask construction is a breathing adaptor provided on the interior side of the mask face, which encloses a one-way respirator. The breathing adaptor maintains the mouth and nose spaced apart from the filter, and efficiently directs breathing efforts to equalize inhalation airflow via substantially all of the filter, while the one-way valve eases exhalation airflow and reduces condensation on the interior side of the visor. Thus, filter utilization is improved and the filter protection time is extended, for increased safety.

15 Claims, 5 Drawing Sheets

PROTECTIVE BREATHING MASK

FIELD OF THE INVENTION

The present invention relates to protective gas masks and other protective breathing devices, more particularly, to an improved fire-resistant protective breathing mask for reducing the respiratory health risks and mortality rates associated with smoke and fume inhalation in fire, gas or other toxic air emergencies.

BACKGROUND OF THE INVENTION

There are known gas masks and protective breathing devices used to insure safe breathing in situations where harmful or deadly air is generated, such as in fire emergencies, chemical or biological warfare, or industrial chemical gas hazards. As referred to herein, the term "toxic air" will be used to refer to gases generated by fire, solid particles, smoke particulate matter, chemical warfare agents, including nerve agents, blood agents, choking agents and blister agents, biological warfare agents such as anthrax, botulinium, and hazardous industrial chemical gases, such as ammonia, chlorine, carbon tet, etc.

While there are well-developed protective breathing devices used by firefighting personnel entering the scene of a fire to rescue fire victims, the general public has not used them.

In recent years, there have become available lightweight, portable protective breathing masks for use by civilians, to reduce smoke inhalation mortality rates. These devices are designed with the recognition that in fire emergencies, immediately upon the outbreak of a fire, every second becomes precious in the preservation of life. By the time firefighters arrive at the scene of the fire and locate the victims for rescue procedures, many victims have been overcome with toxic air and may be unconscious and unable to aid the rescue efforts. Untold numbers of fire victims perish not by contact with flames, but through an inability to breathe just long enough to safely exit burning buildings, or be located and rescued by firefighters. A prime example of an institution requiring these devices is a tourist hotel, where many tragic fire fatalities of the past may have been avoided were protective breathing masks instantly available.

Examples of the protective breathing masks available in the market include the mask described in U.S. Pat. No. 4,870,959 to Reisman, owned by the owners of the present invention. The patent discloses a protective breathing mask made of fire-resistant, stretchable elastomeric material shaped as a hood with an access opening through which the head is placed for wearing the mask over the head and enclosing it such that a substantially airtight closure is provided at the neck. A portion of the mask is provided with a transparent visor for the eyes, and the hood has filter materials sealed thereto at a mouth location, with the filter comprising a plurality of fire-resistant flexible layers, at least one of which having embedded therein activated charcoal.

Other examples of protective breathing masks include that described in U.S. Pat. No. 5,392,465 to Shou, which describes a mask made of fireproof cloth impregnated with a smoke preventing chemical substance, and having a transparent visor. U.S. Pat. No. 5,214,803 to Schichman describes a smoke hood which can be secured substantially airtight about the user's neck and filled with ambient air to enable breathing of the air within the hood, for a predetermined time, free of external air.

U.S. Pat. No. 5,146,636 to De La Pena discloses a heat and smoke protective hood comprising a bag-like head covering of a heat-resistant, substantially gas-impermeable sheet material adapted to fit loosely over the head, with a filter provided in an aperture of the hood covering, and a stretchable annular neck portion attached to an open end of the head covering for sealing around the neck.

U.S. Pat. No. 4,935,966 Hosouchi et al discloses a smokeproof foldable bag having an opening which, when unfolded, can be used to receive a person's head therein, to prevent smoke inhalation during a fire. A fire and smoke protective hood is disclosed by U.S. Pat. No. 5,113,527 to Robertson-McKenzie, and is made from a high temperature-resistant plastics material coated on its exterior with a layer of titanium to reflect heat.

Among the goals in design of protective breathing masks as aforementioned is the desire to achieve easy breathing. In achieving this goal, two of the design constraints faced are related to the type of filter used and the interior mask volume, which determines the amount of "dead space" once the user dons the mask. Those masks which have a stretchable hood, such as the Reisman patent, minimize the "dead space" by pressing the filter close up against the mouth, and achieve easy breathing by use of a thin filter which provides low resistance to exhaled air. These features tend to reduce psychological pressure on the user, since they assist in minimizing the buildup of heat, vapor and CO2 gas.

A drawback in the existing designs which minimize the "dead space" is that by pressing the filter against the mouth and nose, the filter surface area is not effectively utilized and uneven airflow distribution is provided, reducing the useful filter protection time. An inverse relationship exists between increased protection time and easy breathing, since increasing the filter materials increases resistance. Alternatively, by increasing the space between the mouth, nose and the filter, air distribution is more uniform, and thus the filter utilization is improved. However, the "dead space" increases, exacerbating the psychological effects, due to heat, vapor and CO2 gas buildup.

It would therefore be desirable to provide a protective breathing device which, in addition to being convenient, affordable and instantly available to civilians in toxic air emergencies, achieves easy breathing and increased protection time.

SUMMARY OF THE INVENTION

Accordingly, it is a principal object of the present invention to overcome the above-mentioned difficulties by provision of protective breathing apparatus for fire, health and toxic air emergencies. It is another object of the invention to provide a convenient, lightweight, affordable, fire-resistant and instantly available gas mask for protection against toxic air.

In accordance with a preferred embodiment of the invention, there is provided an improved protective breathing mask having fire-resistant stretchable material of not less than about 300% stretchability shaped as a hood and having an access opening through which the head is placed for wearing the mask over the head and enclosing it such that a substantially airtight closure is provided at the neck, said stretchability inherently providing, without ancillary tightening means, a minimum unoccupied interior volume of said hood such that, upon donning, the inrush of surrounding toxic air is minimized, at least a portion of the mask providing a transparent viewing area for the eyes, a mouth location of said stretchable material being replaced by a filter having materials sealed thereto including a plurality of fire-resistant flexible layers at least one of which is an activated cloth having activated charcoal fibers in the form of woven or non-woven cloth, wherein the improvement comprises:

breathing adaptor means comprising a flexible material within the mask interior enclosing at least the mouth and maintaining spaced apart therefrom a one-way respirator and the filter, said breathing adaptor means providing uniform inhalation airflow via substantially all of the filter, while easing exhalation airflow via said one-way respirator.

In the basic mask construction, a combination of stretchable and fire-resistant materials are employed in a hood-like construction providing viewing and breathing protection features. The combination of materials also provides the mask with particularly advantageous features suited to portability, compactness, and instant availability, which are achieved by its lightweight, flexible construction.

The hood-like construction may be fabricated by a molding or dipping process, providing a seamless enclosure with front and back panels, and a bottom edge which is formed with an access opening to the airtight interior volume enclosed by the mask. The access opening can be pulled apart to enable the user to quickly and easily slip the entire mask over the head.

In addition, the access opening is shaped so as to fit snugly around the user's neck, providing a substantially airtight closure without the aid of an additional closing device. The contour of the mask is designed to reduce "dead space" and provide the minimum interior volume needed for wearing over the head. This design minimizes the inrush of surrounding toxic air when the access opening is pulled apart by the user, in donning the mask.

Portions of the material in the front panel of the mask are removed and are replaced at eye and mouth locations by fire-resistant transparent and filter materials respectively providing viewing and breathing capabilities. The properties of these materials are uniquely suited to the life-saving functions they perform, in enabling the user to maintain his vision and breathing while making his way to safety in fire, gas and toxic air emergencies.

For the viewing portion of the mask, the transparent material is a high-temperature resistant and fire-retardant thermosettic material which does not melt even on contact with a flame. The filter material is provided in portions of the mask to either side of the nose so as to maintain good airflow distribution. Fabricated from a combination of materials provided in several layers, each of the filter materials has a distinct function. For example, three layers of active charcoal cloth are interleaved with two layers of a particle filter. The activated charcoal cloth layers serve to eliminate poisonous gases and acids from the air and the remaining layers provide an air filter to eliminate airborne particles.

A feature of the invention is the overall shape of the mask which is appropriate for most head sizes, without interference from scalp hair. The viewing and filter materials are designed to cover a maximum surface area of the front panel of the mask, making it suitable for many users despite a wide variation in head and neck sizes.

The improvement to the basic mask construction is a breathing adaptor provided on the interior side of the mask face, which encloses a one-way respirator. The adaptor efficiently directs breathing efforts to equalize inhalation airflow via substantially all of the filter, while the one-way valve eases exhalation airflow and reduces condensation on the mask interior viewing portion. Thus, filter utilization is improved and the filter protection time is extended, for increased safety. The breathing adaptor can be provided as a mouthpiece or it may be shaped to encompass the perimeter of the filter.

Other features and advantages of the invention will become apparent from the following drawings and description.

BRIEF DESCRIPTION OF THE DRAWINGS

For a better understanding of the invention, reference is made to the accompanying drawings in which like numerals designate corresponding elements or sections throughout, and in which.

DETAILED DESCRIPTION OF A PREFERRED EMBODIMENT

Figure 1A:
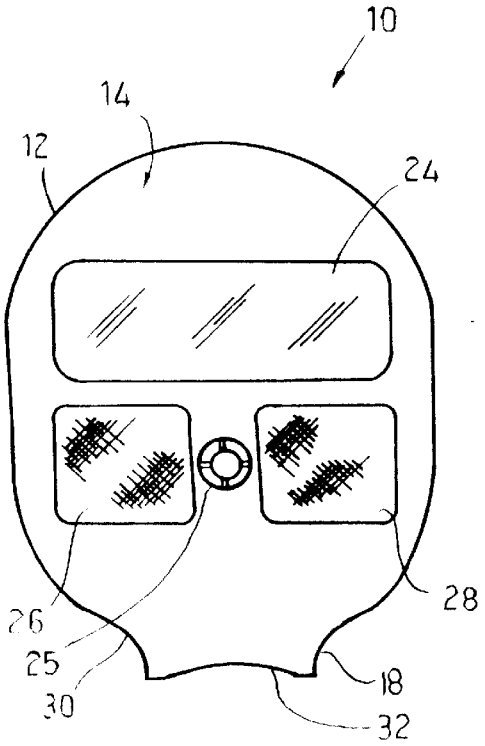
FIGS. 1*a–b* show, respectively, front and interior views of an improved protective breathing mask constructed in accordance with the principles of the invention.
Figure 1B:
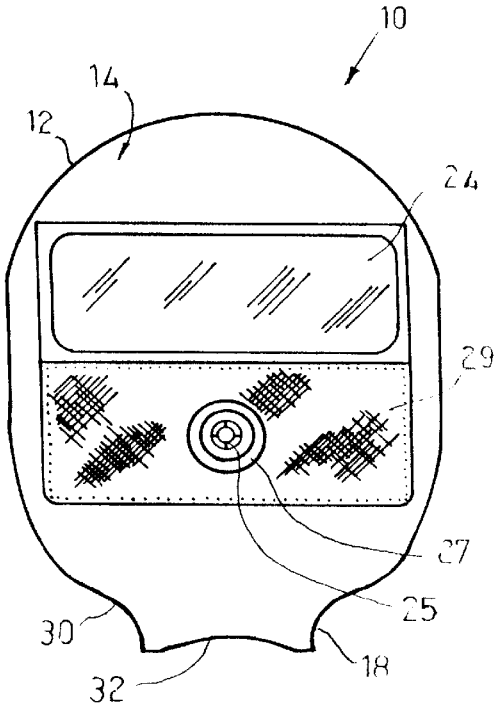

Referring now to FIGS. 1*a–b*, there are shown respectively, front and interior views of a protective breathing mask 10 constructed in accordance with the principles of the present invention. The mask 10 comprises a hood-like construction made of a stretchable material 12 such as neoprene rubber or silicone which is fabricated as a thin sheet providing front and rear panels 14 and 16 (rear panel not visible) joined at a bottom edge 18. Stretchable material 12 typically has a minimum 700% stretchability, can withstand temperatures of 250° C., and has an approximate thickness of between 0.2–0.5 mm.

Front and rear panels 14 and 16 of the hood-like construction are formed as one continuous surface in the manufacturing process. Portions of material 12 in front panel 14 are cutout to provide a viewing portion (visor) 24 and filter portions 26 and 28, having a one-way breathing respirator 25 disposed between them. FIG. 1*b* shows an interior view of front panel 14, and reveals a breathing adaptor 27 attached within the perimeter of a filter 29 comprising filter portions 26, 28. Filter portions 26, 28 form one continuous unit within filter 29. Breathing adaptor 27 is located directly behind respirator 25.

The lower portions 30 of mask 10 are slanted inwardly toward the bottom edge 18, in which an access opening 32 is provided in stretchable material 12. By pulling stretchable material 12 apart, access opening 32 provides access to the interior volume of mask 10 between front and rear panels 14 and 16, allowing it to be placed over a user's head. At bottom edge 18, material 12 is made thinner, to ease the stretching effort.

As further described herein, the protective breathing mask 10 of the present invention is constructed so that respective visor and filter portions 24, 26 and 28 thereof are fabricated of fire-resistant transparent material and fire-resistant filter materials. These materials are joined by bonding to stretchable material 12 in sealing fashion using suitable contact glue or stitching so as to provide an enclosed interior volume of mask 10. When mask 10 is worn in toxic air emergencies, the material forming visor 24 provides the user with vision capabilities, while the filter portions 26 and 28 filter out toxic air and enable the user to continue breathing while making his way to safety.

Figure 2:
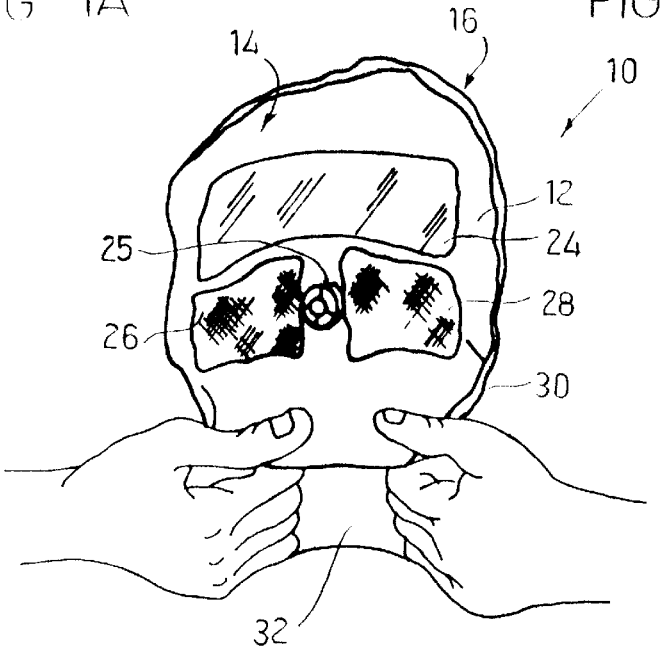
FIG. 2 shows the mask of FIG. 1 being pulled open at an access opening for placement over the user's head.

Referring now to FIG. 2, there is shown a front view of mask 10 of FIG. 1 in which the user has pulled apart stretchable material 12 at access opening 32 in preparation for placement of the mask 10 over his head. Since access opening 32 is formed in bottom edge 18 which does not contain a seam, pulling apart this area of stretchable material 12 does not subject it to stresses which are likely to cause tearing or other deformation. This feature of the design insures the integrity of both the mask shape and its interior volume once placed over the user's head.

By virtue of its design, access opening 32 fits snugly around the user's neck once the mask is in place, thus providing a substantially airtight closure, without the aid of an additional closing device. The integrated hood protects the entire head from chemical or biological agents and other toxic gases that may enter through the eyes or skin. By sealing at the neck, the mask eliminates problems such as face fit, sizing and sealing on hair.

It is a particular feature of the inventive protective breathing mask 10 that it is contoured so as to provide a minimum interior volume while being suitable for a wide range of head sizes. This provides an additional safety feature in that when used in a toxic air emergency, the inrush of surrounding toxic air containing smoke or gas is minimized when stretchable material 12 is pulled apart at access opening 32 for wearing purposes. This contour, defined in part by lower portions 30 of side edges 20, minimizes the user's initial exposure to toxic air within its interior volume when the mask 10 is first placed over his head.

Another particular feature of the present invention is the use of materials for visor and filter portions 24, 26 and 28 which provide characteristics uniquely suited to this application, to realize the life-saving functions achieved by the inventive design. Therefore, in the preferred embodiment, these materials are chosen from a group of materials meeting the necessary requirements of being fire-resistant, non-melting and having high temperature withstand capabilities, while being lightweight and flexible.

In accordance with the inventive design, visor 24 is made of a thin, fire-retardant, transparent, thermosettic material which can withstand temperatures of up to 400° C., such as that sold under the tradename Kapton and currently available from DuPont (USA). The thermosettic properties of this material are such that it does not melt even on contact with a flame, instead reducing to a powdered substance which evaporates, but which cannot melt onto the skin or cause breathing difficulties.

Filter 29 is made of a plurality of layers (see FIG. 7) of fire-resistant filter material containing a combination of several materials. The filter material layers each have a distinct function, with some of the layers being activated charcoal cloth and other layers providing a particle filter for submicron smoke particulates. The activated charcoal cloth layers serve to eliminate poisonous gases and acids from the air and the remaining layers eliminate airborne particles.

As previously stated, the choice of materials used in construction of mask 10 is based on the combined objectives of providing life-saving functions while exhibiting fire-resistant properties and achieving a lightweight, flexible design. In keeping with these objectives, the materials chosen for the preferred embodiment achieve a mask 10 construction capable of being folded into individual packages of 8×12 cm weighing 200 grams or less, suitable for carrying in a shirtpocket or handbag.

The packaging options for the inventive protective breathing mask 10 are wide and varied, one possible option being the use of small plastic bags into which each mask is folded and which are hermetically sealed to prolong shelf life. These individual packets could then be distributed via retail marketing establishments, making the mask readily accessable to consumers. Another important channel of distribution would be through institutions where fire hazards may exist, notably hotels and other public lodging establishments, where the mask 10 may be provided as standard equipment in guest rooms, instantly available in fire and gas emergencies. Alternatively, the mask may be individually or bulk packed for victim rescue applications.

Figure 3:
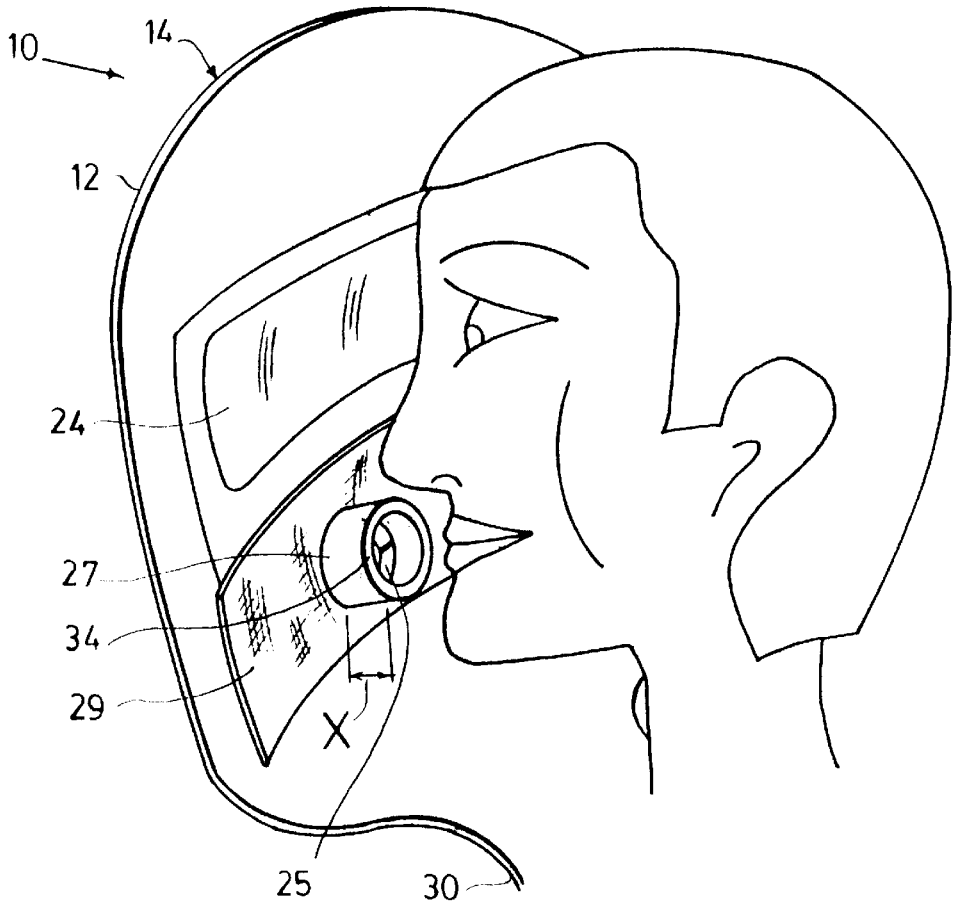
FIGS. 3–4 show, respectively, an interior perspective view and a partial cutaway view of the user wearing the mask.
Figure 4:
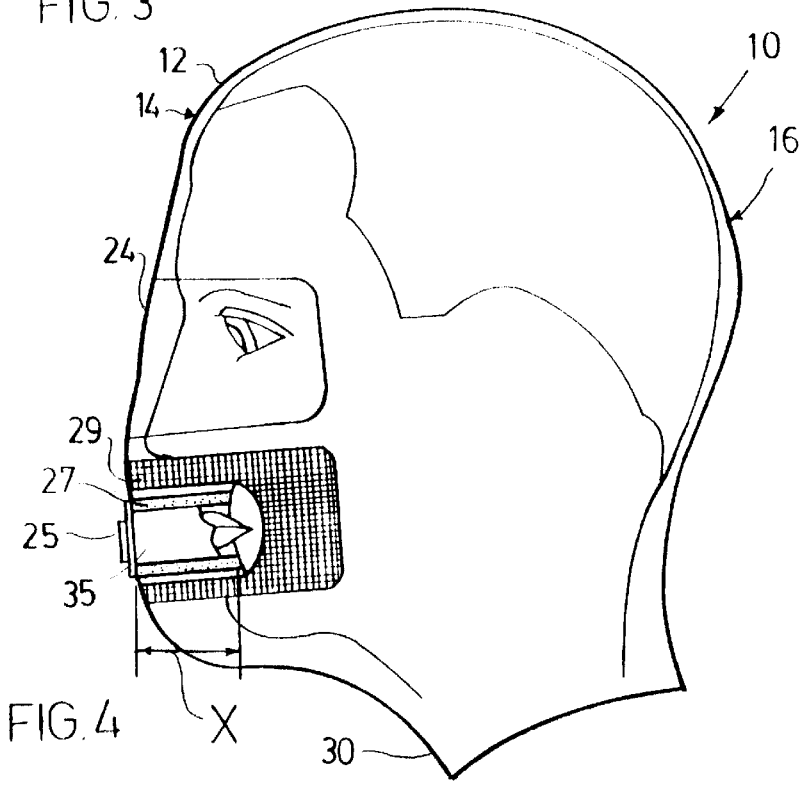

Referring now to FIGS. 3–4, there are shown, respectively, an interior perspective view of the front panel 14 and a partial cutaway view showing a user wearing mask 10 over his head. As worn, access opening 32 in stretchable material 12 provides a snug fit of mask 10 around the user's neck. Visor 24 covers a rectangular area, for a wide viewing area.

In accordance with a preferred embodiment of the present invention, the improvement to the basic mask construction comprises a breathing adaptor 27 provided within the perimeter of filter 29 to improve airflow distribution during breathing. Breathing adaptor 27 comprises a porous, flexible material shaped as a mouthpiece. Unlike a conventional mouthpiece, adaptor 27 does not interfere with, limit or restrict the ability to clearly communicate verbally. Stretchable material 12 holds adaptor 27 against the mouth, so that it is self-positioning, and cloth layer 34 increases comfortability of adaptor 27 against the skin.

Typically, breathing adaptor 27 is fabricated as open-cell sponge material with a density of 30 ppi (pores/inch). The material can be stored compactly, but retains its shape. As described further herein, adaptor 27 equalizes inhalation airflow via substantially all of filter 29, while allowing easy exhalation airflow via one-way respirator 25. By facilitating exhalation, respirator 25 reduces condensation on mask visor 24, and controls the accumulation of heat, moisture and CO2 buildup.

The visor and filter portions 24 and 29 provide the user with the ability to maintain viewing and breathing capabilities for a period of approximately 15 minutes or more, depending on the intensity of heat and the concentration of toxic air while a user makes his way to safety.

The mask may be provided with a highly reflective surface coating to enable it to be seen by rescue teams, or alternatively, the mask may have large printed lettering, such as the name of the hotel in which it is used. The lettering is useful since its light reflection characteristics assist in identifying the locations of victims. Alternatively, stretchable material 12 may be fabricated of a bright yellow color.

As shown in the side partial cutaway view of FIG. 4, the mouthpiece shape of breathing adaptor 27 is large enough to comfortably enclose the mouth, and provide a breathing passage 35 by maintaining a space (X) between the mouth and nose and filter 29. By appropriate selection of material, breathing adaptor 27 sets up an airflow resistance slightly higher than respirator 25, the latter having a slightly lower cracking pressure. Thus, inhalation airflow is substantially uniform, via filter 29 and passing via breathing adaptor 27, while exhalation airflow is resisted by adaptor 27 and exits mainly via respirator 25 only.

Figure 5:
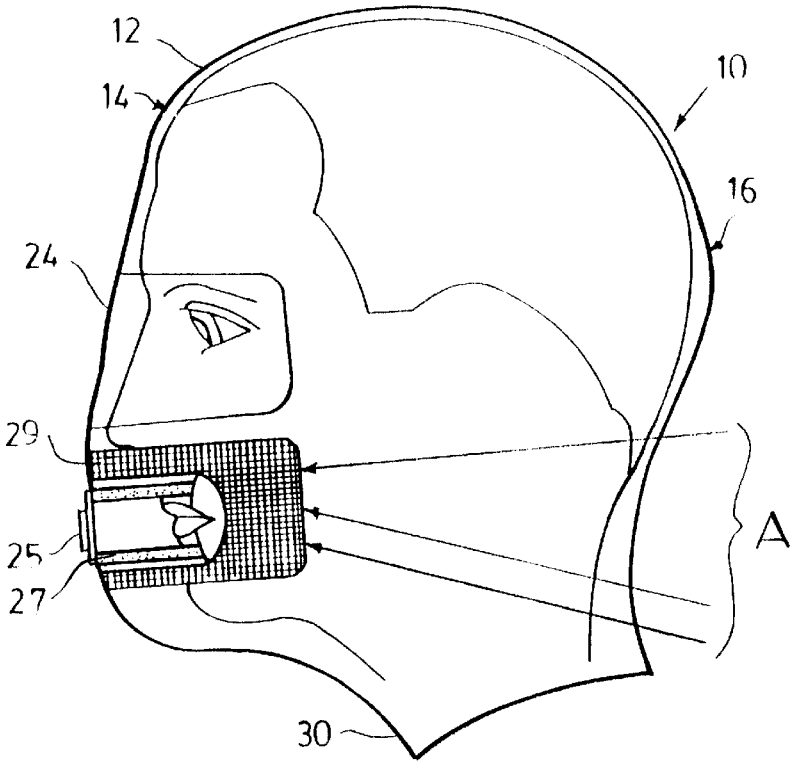
FIGS. 5–6 show schematic diagrams of, respectively, inhalation and exhalation airflow patterns when using the mask.
Figure 6:
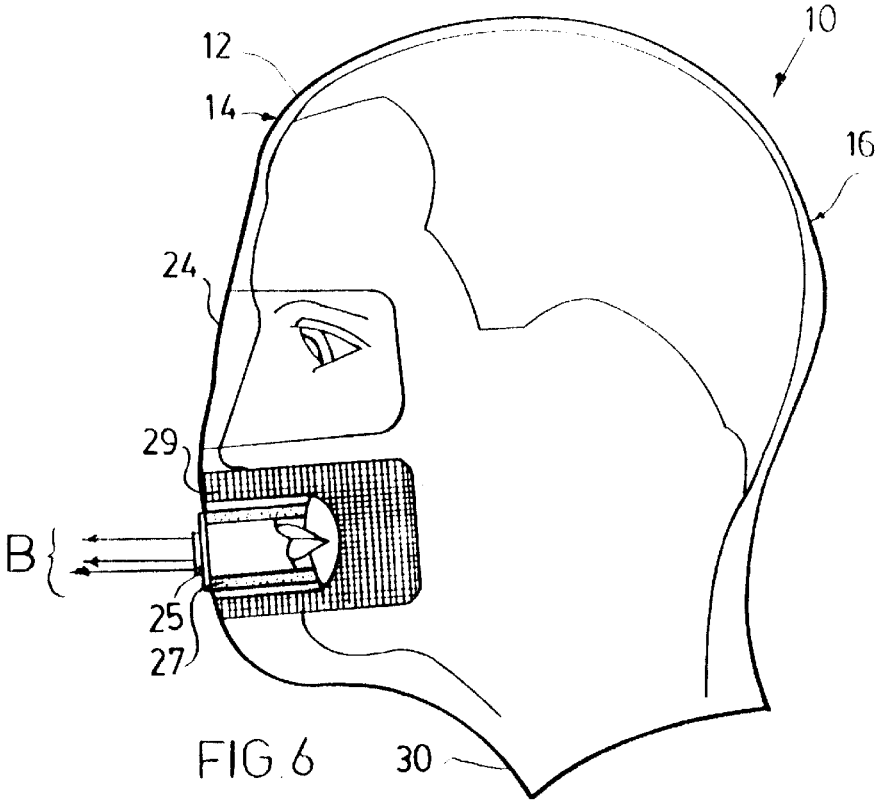

Referring now to FIGS. 5–6, there are shown schematic diagrams of inhalation and exhalation airflow patterns when using mask 10. During inhalation breathing (arrows "A"), airflow via filter 29 is directed into the mouth via breathing adaptor 27. By its design, filter 29 is provided as a wrap-around shape larger than the mouth itself, so that substantially all of filter 29, including its edges, contributes to the inhalation airflow.

During exhalation breathing (arrows "B"—FIG. 6), breathing adaptor 27 tends to resist the exhalation airflow back into the mask interior, while one-way respirator 25 facilitates this airflow, increasing the user's comfort level. By utilizing substantially all of filter 29 for passage of inhalation airflow, and facilitating exhalation airflow, mask 10 provides improved filter utilization and the overall filter protection time is extended, for increased safety. The large surface area of filter 29 and thin design allow a large volume of air to flow therethrough at a low velocity, resulting in a low pressure drop. The low pressure drop makes it very easy to draw a breath of air through mask 10, which is very important for victims who may have difficulty breathing.

A test was conducted to determine the concentration of CO2 buildup in the inhaled air, both for the basic mask construction and the improved design. The results are shown below:

| Breathing Rate | Basic Mask Dead Space/CO2 conc. | | Improved Mask Dead Space/CO2 conc. | |
|---|---|---|---|---|
| Liters/min | (ml) | (%) | (ml) | (%) |
| 15 (at rest) | 624 | 3.1 | 510 | 2.55 |
| 50 (active) | 764 | 1.9 | 646 | 1.6 |

As can be readily seen, the improved mask design reduces the dead space and CO2 buildup, thus increasing safety.

Figure 7:
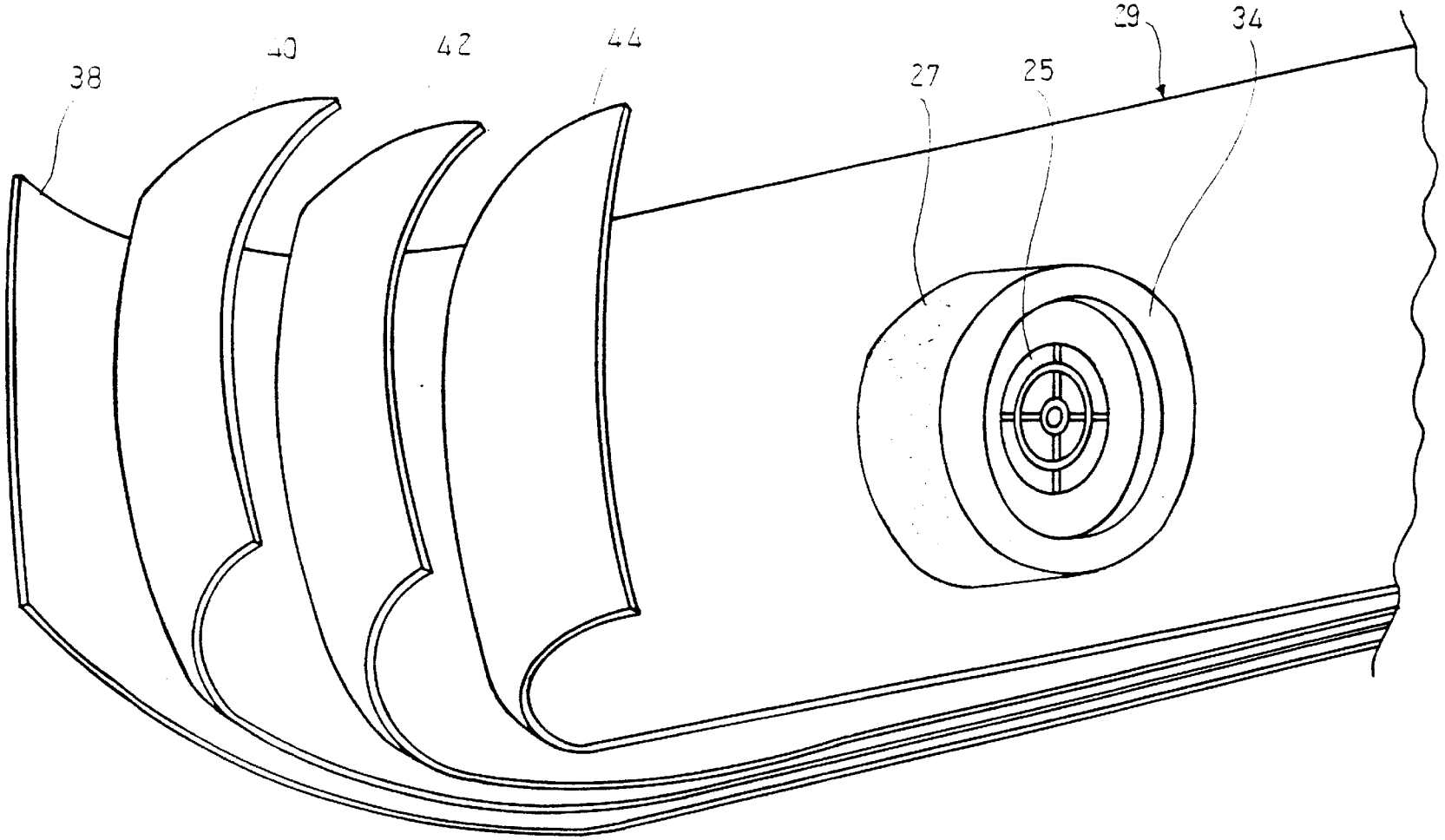
FIG. 7 shows the filter material featuring a layered construction of filter elements and a breathing adaptor.

In FIG. 7, the construction of filter 29 and breathing adaptor 27 is shown. The filter is provided as layers of material, each having a distinct function. In a preferred embodiment, the combined filter materials comprise four groups of layers, outer layer 38 being made of high-temperature resistant and fire-retardant material, thereby protecting the inner layers.

Layer group 40 is a particle filter made of one or more electrostatically-charged polymer fiber layers to trap particles above 0.3 microns in diameter so as to provide an air filter for smoke particulates, with an effectiveness of 99% or greater. The electrostatic charge provides high filtering effectiveness and low airflow resistance, allowing easy breathing. A particle filter may be used such as manufactured by 3M Corporation (USA) under the tradename Filterette, or as manufactured by Hepworth.

Layer group 42 comprises one or more layers of activated charcoal cloth, woven or non-woven, made of activated charcoal fibers. The activated charcoal fibers have a characteristically high surface area-to-weight ratio (typically 1500 sq. m/gram) which is useful for efficient physical adsorption of organic gases. The charcoal cloth may be impregnated with active ingredients such as copper, which provide chemical absorption of acidic and inorganic gases from the air.

Layer 44 is an internal pad of non-woven material which soft and pleasant to the touch. It prevents direct contact between the facial skin and the activated charcoal cloth layers 42, so as to avoid friction with the skin and smudging thereof.

The filter material layers 38–44 may be laminated by placing intermediate sheets (not shown) between the different materials in the layers, with the intermediate sheet providing a heat-activated glue. When the layers 38–44 are passed through a hot press, laminated layers are formed. It is preferable to form the intermediate sheets so that the laminated layers result around the edges of the materials only, leaving the central area with spacing between layers 38–44 to aid in absorption of toxic air. The combined filter material layers may also be sewn together and to the mask itself.

In alternative embodiments, the number and arrangement of the filter material layers 38–44 may vary, and this will result in variation of the mask filtering capabilities and the duration of the filter material effectiveness in absorbing smoke, gas and particulates. Several charcoal layers 42 may be used.

Figure 8:
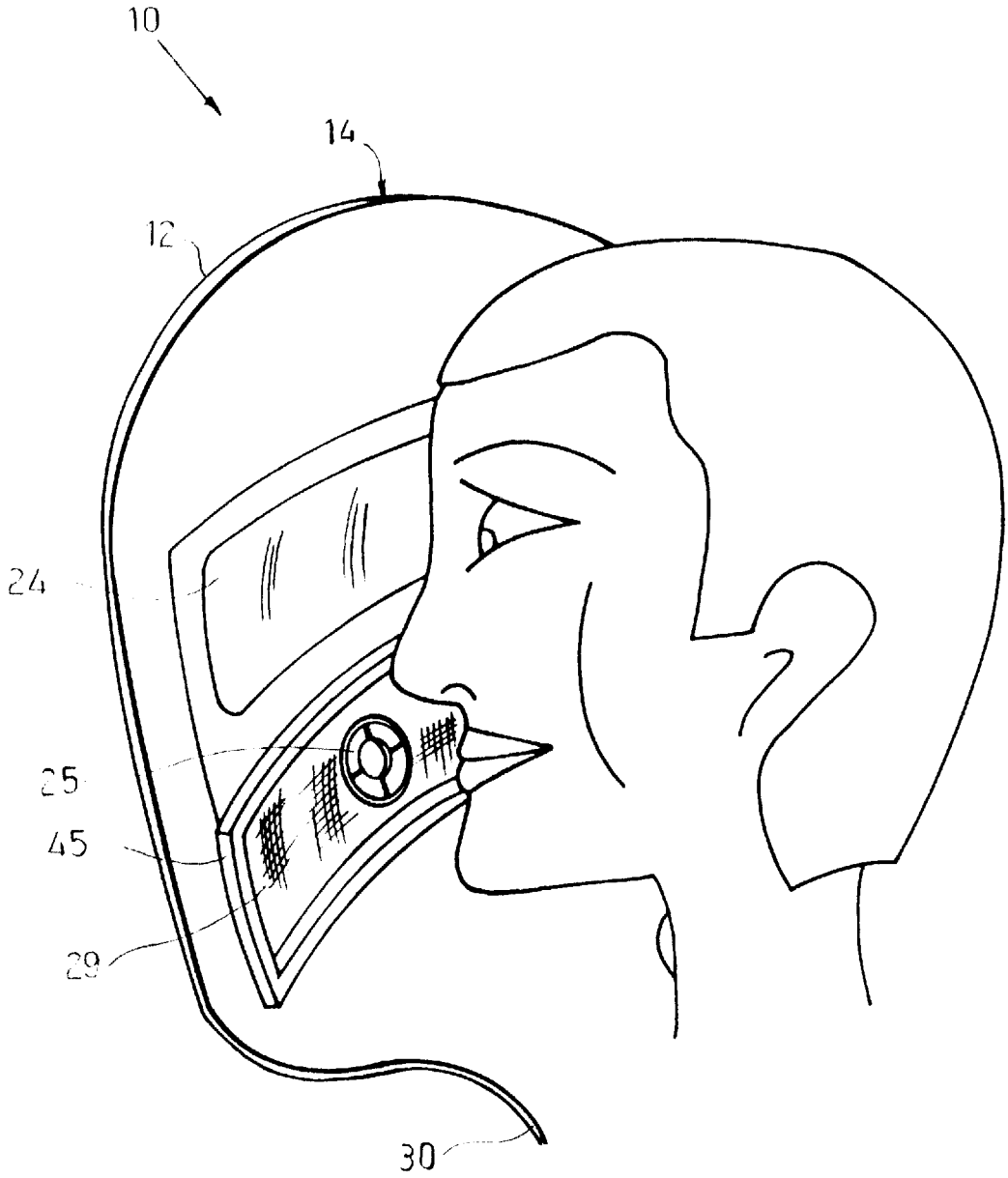
FIG. 8 shows an interior perspective view of an alternative embodiment of the mask, featuring a different adaptor.

Referring now to FIG. 8, there is shown an interior perspective view of an alternative embodiment of the mask. In this arrangement, mouthpiece breathing adaptor 27 is replaced by a ridge-shaped breathing adaptor 45 which is provided as a flexible material shaped to surround the perimeter of filter 29, covering the mouth and nose. Breathing adaptor 45 has a minimum thickness of 30 mm to maintain the mouth and nose spaced apart from filter 29, and provide substantially uniform inhalation airflow, with exhalation airflow via respirator 25.

In summary, it will be seen that the inventive protective breathing mask provides a particulary advantageous combination of life-saving vision and improved breathing capabilities in a lightweight, flexible construction suitable for consumer use, instantly available in toxic air emergencies.

Having described the invention in connection with certain specific embodiments thereof, it is to be understood that the description is not meant as a limitation since further modifications may now suggest themselves to those skilled in the art and it is intended to cover such modifications as fall within the scope of the appended claims.

We claim:

1. An improved protective mask having fire-resistant stretchable material of more than about 300% stretchability shaped as a hood and having an access opening through which a head of a user can be placed for wearing the mask over the head and enclosing it such that a substantially airtight closure is provided at the neck, said stretchability inherently providing, without ancillary tightening means, a minimum unoccupied interior volume of said hood such that, upon donning, the inrush of surrounding toxic air is minimized, at least a portion of the mask providing a transparent viewing area for the eyes, a mouth location of said stretchable material being replaced by a filter having materials sealed thereto including a plurality of fire-resistant flexible layers at least one of which is an activated cloth having activated charcoal fibers in the form of woven or non-woven cloth, wherein the improvement comprises:

breathing adaptor means comprising a flexible, porous material having a slight airflow resistance and being mounted within the mask interior capable of enclosing at least the mouth of the user and maintaining spaced apart therefrom a one-way respirator and the filter, said one-way respirator having a cracking pressure slightly lower than said airflow resistance, said breathing adaptor means providing uniform inhalation airflow with a low pressure drop via substantially all of the filter and said flexible, porous material enclosing at least the mouth, while easing exhalation airflow by directing it so as to minimize passage thereof through said flexible, porous material, causing substantially all of said exhalation airflow to flow via said one-way respirator.

2. The mask of claim 1 wherein the filter has a perimeter and said breathing adaptor means is shaped as a mouthpiece disposed within said perimeter of the filter, and is held over the mouth by said stretchable material.

3. The mask of claim 1 wherein said breathing adaptor means is self-positioning over the mouth.

4. The mask of claim 1 wherein said breathing adaptor means is fabricated of open cell sponge material with a density of 30 ppi, said open cell sponge material being foldable.

5. The mask of claim 4 wherein said breathing adaptor means is compressable to fit a compact packing envelope.

6. The mask of claim 4 wherein said breathing adaptor means minimizes interference with the mouth and speech.

7. The mask of claim 4 wherein said sponge material has a thickness of approximately 30 mm.

8. The mask of claim 1 wherein said breathing adaptor means has a resistance to airflow slightly higher than said one-way respirator, insuring exhalation airflow via the latter.

9. The mask of claim 1 wherein breathing adaptor means enables said inhalation airflow absent an inhalation valve.

10. The mask of claim 1 wherein said stretchable material is made thinner near said access opening, for easy stretching.

11. The mask of claim 1 wherein said stretchable material has a stretchability range of approximately 300–700%.

12. The mask of claim 1 wherein said breathing adaptor means is shaped as a ridge surrounding the perimeter of the filter, and held over the mouth and nose by said stretchable material.

13. The mask of claim 12 wherein said breathing adaptor means is compressable to fit a compact packing envelope.

14. The mask of claim 12 wherein said breathing adaptor means minimizes interference with the mouth and speech.

15. The mask of claim 12 wherein said sponge material has a thickness of approximately 30 mm.

* * * * *